US009952617B1

(12) United States Patent
Gupta et al.

(10) Patent No.: US 9,952,617 B1
(45) **Date of Patent: *Apr. 24, 2018**

(54) REFERENCE CURRENT CIRCUIT ARCHITECTURE

(71) Applicant: International Business Machines Corporation, Armonk, NY (US)

(72) Inventors: Sonali Gupta, Bangalore (IN); Arindam Raychaudhuri, Bangalore (IN)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/406,921

(22) Filed: Jan. 16, 2017

Related U.S. Application Data

(63) Continuation of application No. 15/364,689, filed on Nov. 30, 2016.

(51) Int. Cl.
*G05F 3/26* (2006.01)

(52) U.S. Cl.
CPC ..... *G05F 3/262* (2013.01)

(58) Field of Classification Search
CPC ..... G05F 3/26; G05F 3/262
USPC ..... 327/513, 538, 539, 543
See application file for complete search history.

(56) References Cited

U.S. PATENT DOCUMENTS 5,604,427 A * 2/1997 Kimura ..... G05F 3/30 323/313
5,982,201 A 11/1999 Brokaw et al.
6,914,831 B2 7/2005 Di Iorio
7,113,025 B2 9/2006 Washburn
7,224,210 B2 5/2007 Garlapati et al.
7,961,027 B1 6/2011 Chen et al.
9,407,254 B1 8/2016 De et al.
(Continued)

FOREIGN PATENT DOCUMENTS

EP 0794478 A3 9/1997

OTHER PUBLICATIONS

Bendali et al., "A 1-V CMOS Current Reference With Temperature and Process Compensation", IEEE Transactions on Circuits and Systems—I: Regular Papers, vol. 54, No. 7, Jul. 2007, © 2007 IEEE, 6 pages.

(Continued)

*Primary Examiner* — William Hernandez
(74) *Attorney, Agent, or Firm* — Steven F. McDaniel

(57) ABSTRACT

An apparatus includes a plurality of mirrored transistor pairs configured to provide a first output current, and a second output current that is substantially equal to the first output current. The apparatus also includes a load isolation transistor configured to pass the first output current along to a resistive load and a first and a second biasing transistor configured to bias the load isolation transistor with a load biasing voltage. A gate and drain of the second biasing transistor may be connected to a gate of the load isolation transistor and a drain of the first biasing transistor. Furthermore, a source of the second biasing transistor may be connected to a gate of the first biasing transistor. The width-to-length ratio of the load isolation transistor, the first biasing transistor, and the second biasing transistor are selected to eliminate PTAT dependencies in the first output current.

1 Claim, 4 Drawing Sheets

(56) References Cited

U.S. PATENT DOCUMENTS

| | | | |
|---|---|---|---|
| 2007/0182478 | A1 | 8/2007 | Mun et al. |
| 2014/0028409 | A1 | 1/2014 | Mahooti et al. |
| 2016/0211030 | A1 | 7/2016 | Chen et al. |
| 2017/0003704 | A1 | 1/2017 | Marinca |

OTHER PUBLICATIONS

Fiori et al., "A New Compact Temperature-Compensated CMOS Current Reference", IEEE Transactions on Circuits and Systems—II: Express Briefs, vol. 52, No. 11, Nov. 2005, © 2005 IEEE, 5 pages.

Sansen et al., "A CMOS Temperature-Compensated Current Reference", IEEE Journal of Solid-State Circuits, Year: 1988, vol. 23, Issue: 3, DOI: 10.1109/4.324, IEEE Journals & Magazines, © 1988 IEEE, 4 pages.

Yoo et al., "CMOS current reference with supply and temperature compensation", Electronics Letters Dec. 6, 2007 vol. 43 No. 25, 2 pages.

Gupta et al., "Reference Current Circuit Architecture", U.S. Appl. No. 15/364,689, filed Nov. 30, 2016, 18 pages.

IBM Appendix P, list of patents and patent applications treated as related, Jan. 13, 2017, 2 pages.

* cited by examiner

W1 = W2 = 2·W3 = 0.5·W11
W4 = W5 = W6 = W7 = 2·W8 = 2·W9

$$\left(\frac{1}{\sqrt{2(w/L)_1}} + \frac{1}{\sqrt{2(w/L)_2}} - \frac{1}{\sqrt{(w/L)_3}}\right) = 0,$$

REFERENCE CURRENT CIRCUIT ARCHITECTURE

BACKGROUND OF THE INVENTION

The present invention relates generally to electronic circuits such as integrated circuits, and more particularly to providing reference currents in such circuits.

Current-mode circuits are often able to work at higher speed, for a given technology, than voltage-mode circuits. However, reference current sources are typically less stable than reference voltage sources and exhibit various dependencies including temperature dependencies and device technology dependencies. Consequently, a need exists for current sources that are stable across a wide range of temperatures and fabrication process settings.

SUMMARY

An apparatus includes a plurality of mirrored FET transistor pairs configured to provide a first output current, and a second output current that is substantially equal to the first output current. The apparatus also includes a load isolation transistor configured to pass the first output current along to a resistive load. The apparatus also includes a first and a second biasing transistor configured to bias the load isolation transistor with a load biasing voltage. A gate and drain of the second biasing transistor may be connected to a gate of the load isolation transistor and a drain of the first biasing transistor. Furthermore, a source of the second biasing transistor may be connected to a gate of the first biasing transistor. The width-to-length ratio of the load isolation transistor, the first biasing transistor, and the second biasing transistor are selected to eliminate PTAT dependencies in the first output current.

DETAILED DESCRIPTION

At least some of the embodiments disclosed herein recognize that current sources may have proportional-to-absolute-temperature (PTAT) dependencies as well as complementary-to-absolute-temperature (CTAT) dependencies (i.e., components). Many of the embodiments disclosed herein also recognize that PTAT dependencies tend to dominate current sources.

It should be noted that references throughout this specification to features, advantages, or similar language herein do not imply that all of the features and advantages that may be realized with the embodiments disclosed herein should be, or are in, any single embodiment of the invention. Rather, language referring to the features and advantages is understood to mean that a specific feature, advantage, or characteristic described in connection with an embodiment is included in at least one embodiment of the present invention. Thus, discussion of the features, advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention. These features and advantages will become more fully apparent from the following drawings, description and appended claims, or may be learned by the practice of the invention as set forth hereinafter.

Figure 1:
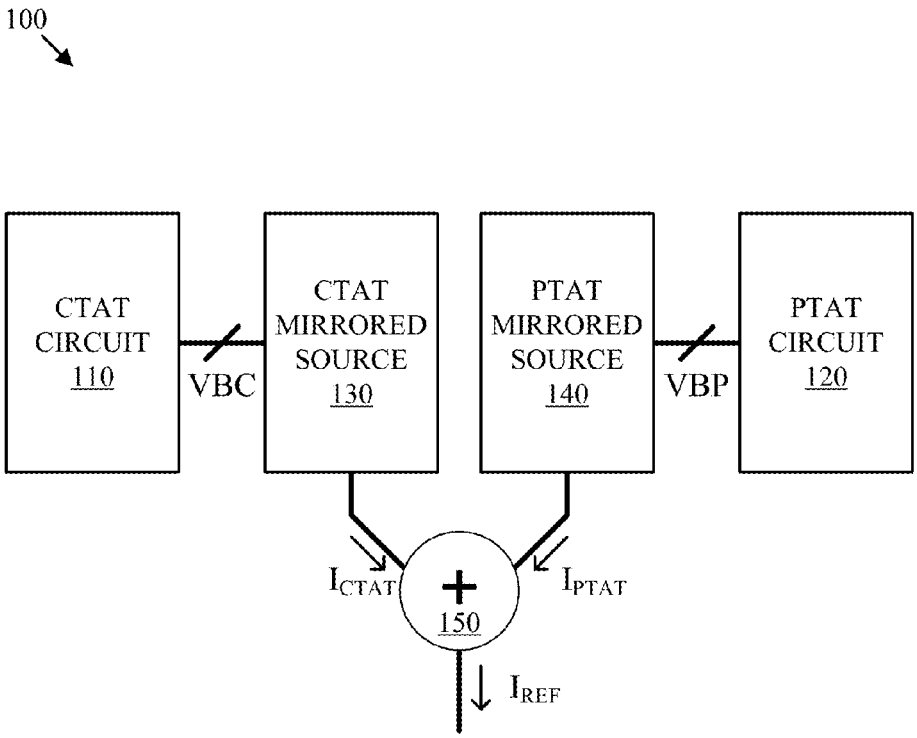
FIG. 1 is a block diagram depicting one example of a reference current generation circuit in which the present invention may be deployed.

FIG. 1 is a block diagram depicting one example of a reference current generation circuit 100 in which the present invention may be deployed. As depicted, the reference circuit 100 includes a complementary-to-absolute-temperature (CTAT) circuit 110, a positive-to-absolute-temperature (CTAT) circuit 120, a CTAT mirrored source 130, a PTAT mirrored source 140, and a current summing element 150. The reference circuit 100 provides a reference current $I_{REF}$ that is stable across a wide range of temperatures and fabrication process settings.

The complementary-to-absolute-temperature (CTAT) circuit 110 may be configured to substantially eliminate PTAT components and thereby be dominated by CTAT components (since the current sources have both CTAT and PTAT components) while the positive-to-absolute-temperature (PTAT) circuit 120 may be dominated by PTAT components. The CTAT circuit 110 may provide one or more biasing voltages VBC to the CTAT mirrored source 130. Similarly, the PTAT circuit 120 may provide one or more biasing voltages VBP to the PTAT mirrored source 140. The biasing voltages VBC may exhibit CTAT dependencies while the biasing voltages VBP may exhibit PTAT dependencies.

The CTAT mirrored source 130 receives the biasing voltage(s) VBC and mirrors a CTAT reference current within the CTAT circuit (not shown) to provide a CTAT reference current $I_{CTAT}$ to the summing element 150. The PTAT mirrored source 140 receives the biasing voltages VBP and mirrors a PTAT reference current within the PTAT circuit (not shown) in order to provide a PTAT reference current $I_{PTAT}$ to the summing element 150.

The current summing element 150 sums the CTAT reference current $I_{CTAT}$ and the PTAT reference current $I_{PTAT}$ proportionally to provide a stable reference current $I_{REF}$. The stable reference current $I_{REF}$ may be stable across a wide range of temperatures and fabrication process settings.

Figure 2:
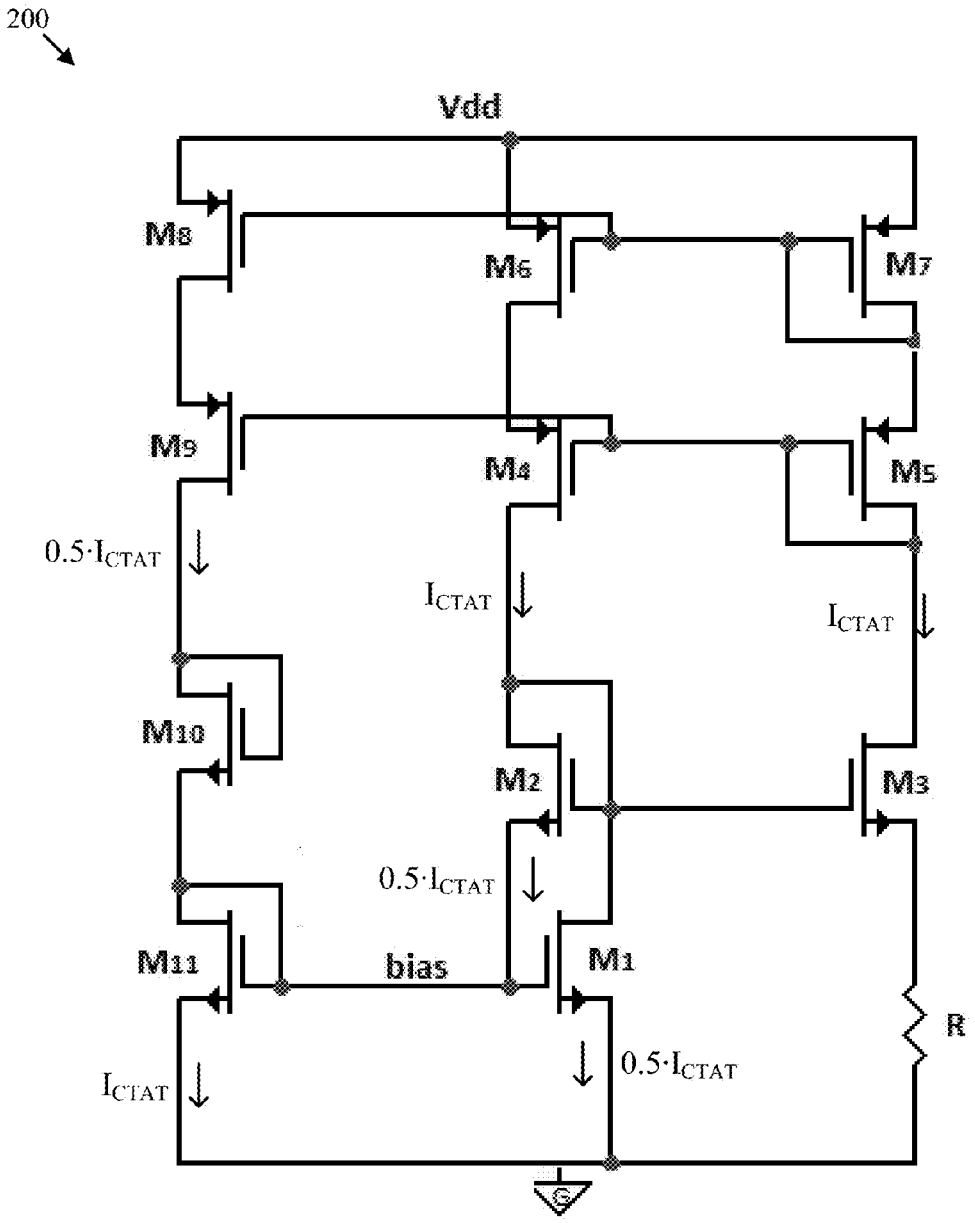
FIG. 2 is schematic diagram of one example of a complementary-to-absolute-temperature (CTAT) circuit in accordance with at least one embodiment of the present invention.

FIG. 2 is schematic diagram of one example of a complementary-to-absolute-temperature (CTAT) circuit 200 in accordance with at least one embodiment of the present invention. As depicted, the CTAT circuit 200 includes a number of transistors (M1-M11) that are arranged to provide a CTAT current $I_{CTAT}$ to a load resistance R. The CTAT circuit 200 is one example of the CTAT circuit 110 depicted in FIG. 1.

Many of the transistors within the CTAT circuit 200 are paired into cascode pairs in order to provide shielding to the first transistor in each cascode pair and reduce the effect of channel modulation in order to reduce the variation in output current flowing through the mirrored devices. For example, the depicted CTAT circuit 200 includes cascode pairs (M7, M5), (M6, M4), (M8, M9), and (M10, M11). Some of those cascode pairs are wired to operate as diode drops. For example, the (M7, M5) cascode pair operates as diodes and provides a pair of diode drop biases (from the supply voltage Vdd) to the (M6, M4) and (M8, M9) cascode pairs.

In addition to the same biasing, the (M6, M4) cascode pair may have the same channel width-to-length (W/L) ratio as the (M7, M5) cascode pair and consequently the same source-to-drain resistance. One of skill in the art will recognize that such an arrangement is a current mirror where the current that flows through the (M7, M5) cascode pair ($I_{CTAT}$) is substantially equal to the current that flows through the (M6, M4) cascode pair. The (M8, M9) cascode pair is also biased by the (M7,M5) (diode) cascode pair and sized to source half the current of the (M7,M5) and (M6,M4) cascode pairs, namely $0.5 \cdot I_{CTAT}$.

The transistor M2 splits the current provided by the (M6, M4) cascode pair ($I_{CTAT}$) into a gate biasing current and a source current for M1. In the depicted embodiment, M1 and M2 are sized to equally split the $I_{CTAT}$ current into two branches of $0.5 \cdot I_{CTAT}$.

The (M10, M11) transistors sink the current provided by the (M8,M9) cascode pair and provides a single diode drop bias to M1 and ensures that the M1 gate voltage is sufficient to maintain M1 in saturation. M11 is also sized so that the total current (I9/I10+I6/I4/I2) through M11 is $I_{CTAT}$. The transistor M3 functions as a load isolation transistor and passes the current provided by the (M7, M5) cascode pair ($I_{CTAT}$) to the resistive load R.

The current that flows through the resistive load R will inherently have both PTAT and CTAT components. However, the PTAT current components through the resistive load R may be eliminated by choosing the W/L ratios of M1, M2, and M3 to conform to the equation:

$$\mathrm{sqrt}(2W_1/L_1)^{-1}+\mathrm{sqrt}(2W_2/L_2)^{-1}=\mathrm{sqrt}(W_3/L_3)^{-1} \quad (1)$$

By conforming to the above equation the resistive load R provides a complementary-to-absolute-temperature (CTAT) response to the first output current.

One of skill is the art will appreciate that the depicted CTAT circuit 200 is substantially independent of supply voltage. In some embodiments, the CTAT circuit 200 exhibits a linear negative temperature dependency across different process corners of FETs some process settings only requires a supply voltage of 1.2 volts. In the depicted embodiment, the reference current ($I_{cTAT}$) is provided using only FETs and no operational amplifiers or BJTs are required.

Figure 3:
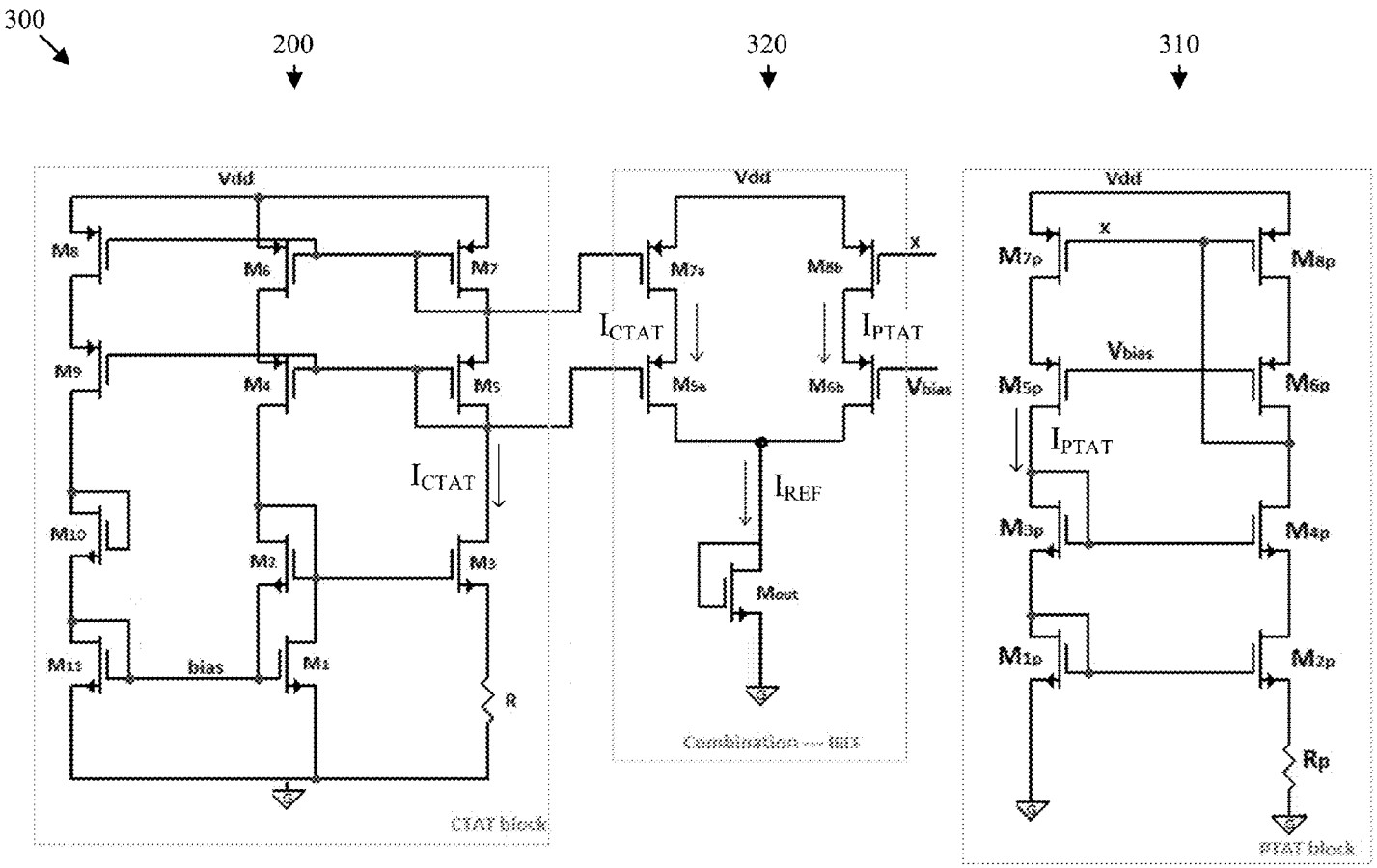
FIG. 3 is schematic diagram of one example of a reference current source in accordance with at least one embodiment of the present invention.

FIG. 3 is schematic diagram of one example of a reference current source 300 in accordance with at least one embodiment of the present invention. As depicted, the reference current source 300 includes the CTAT circuit 200, a PTAT circuit 310, and a summing circuit 320. The summing circuit 320 minors the CTAT current $I_{CTAT}$ in the CTAT circuit 200 and the PTAT current $I_{PTAT}$ in the PTAT circuit 310. The summing circuit 320 also sums the $I_{CTAT}$ and $I_{PTAT}$ to provide a stable reference current $I_{REF}$.

In one embodiment, the reference current ($I_{REF}$) was shown to be substantially independent of supply voltage with a current variation of ±4% across all process corners over an operating temperature range of 10 to 110° C. Similarly, the on-chip resistance was found to be highly stable across a wide supply voltage range at various process fabrication settings and shows negative temperature dependency of less than 4% over the operating temperature range. Furthermore, reference current ($I_{REF}$) was shown to have a power supply rejection ratio (PSRR) of −23.9 db at 100 MHz and −15.8 db at 1 GHz, respectively.

Figure 4:
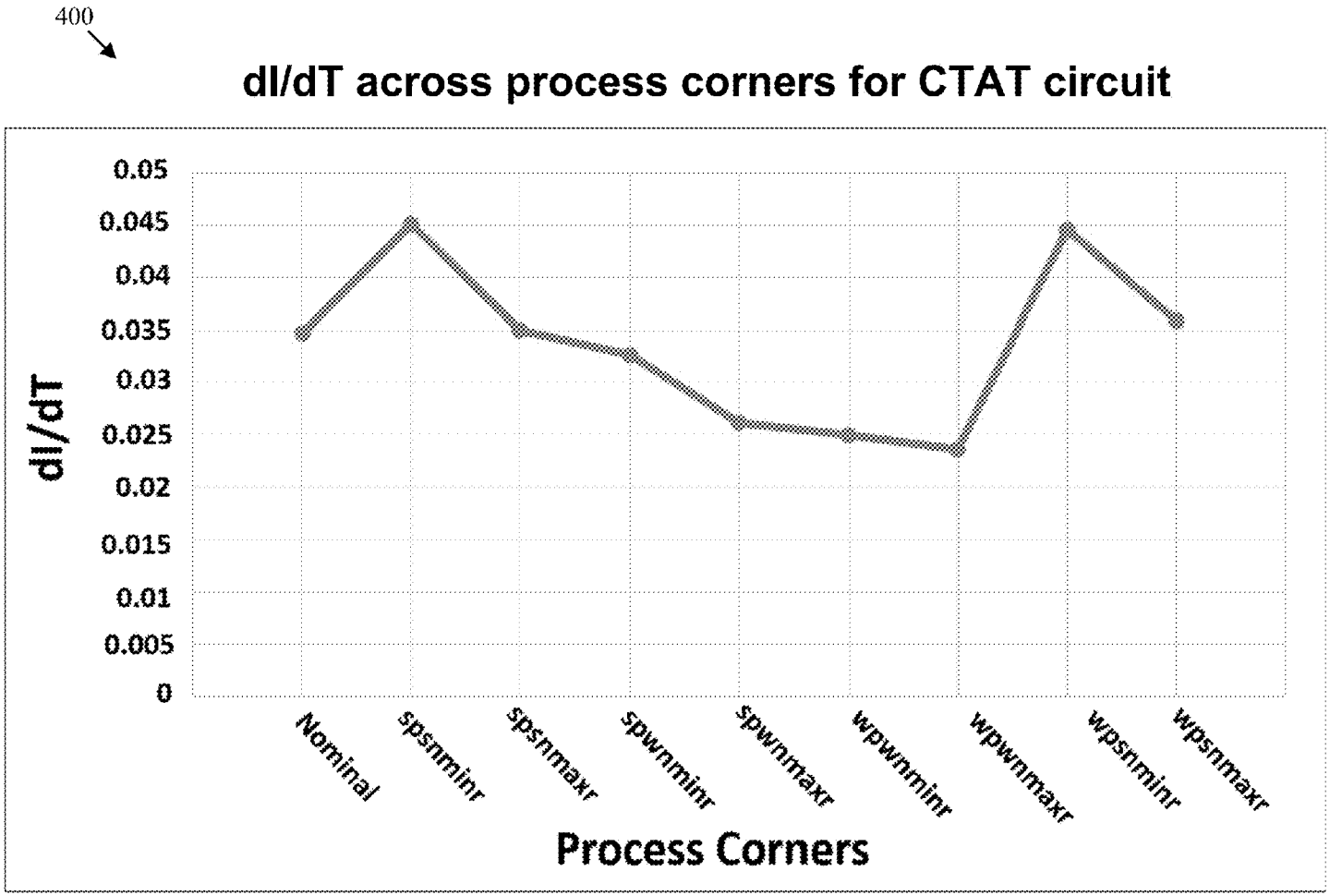
FIG. 4 is a graph that illustrates the temperature stability (across different manufacturing process corners where each corner has different NFET and PFET threshold voltages) of one example of the reference current source of FIG. 3.

FIG. 4 is a graph 400 that illustrates the temperature stability of one example of the reference current source 300 shown in FIG. 3. The depicted graph 400 shows the variation in current (dI) as a function of temperature change (dT) for a variety of fabrication process settings. In the depicted graph the vertical access represents (dI/dT) and the horizontal axis is a set of integers corresponding to a set of fabrication process settings including a nominal setting and 8 process corner settings. Consequently, the variation in current for all possible fabrication settings is likely to be bracketed by the minimum and maximum values of dI/dT shown in the graph.

It should be noted that this description is not intended to limit the invention. On the contrary, the embodiments presented are intended to cover some of the alternatives, modifications, and equivalents, which are included in the spirit and scope of the invention as defined by the appended claims. Further, in the detailed description of the disclosed embodiments, numerous specific details are set forth in order to provide a comprehensive understanding of the claimed invention. However, one skilled in the art would understand that various embodiments may be practiced without such specific details.

Although the features and elements of the embodiments disclosed herein are described in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. An apparatus for providing current, the apparatus comprising:

a plurality of mirrored transistor pairs configured to provide a first output current and a second output current that is substantially equal to the first output current and a third output current that is substantially equal to one half of the first output current;

a load isolation transistor configured to pass the first output current along to a resistive load;

a first and a second biasing transistor configured to bias the load isolation transistor with a load biasing voltage;

a summing circuit that sums mirrored versions of the first output current and a positive to-absolute-temperature (PTAT) current provide by a PTAT circuit block;

wherein a gate and drain of the second biasing transistor are connected to a gate of the load isolation transistor and a drain of the first biasing transistor;

wherein a source of the second biasing transistor is connected to a gate of the first biasing transistor;

wherein a width-to-length (W/L) ratio of the load isolation transistor, the first biasing transistor, and the second biasing transistor are selected to eliminate PTAT dependencies in the first output current;

wherein the first output current is proportional to the sum of threshold voltage of the first and second biasing transistors minus the threshold voltage of the load isolation transistor;

wherein the resistive load provides a complementary-to-absolute-temperature (CTAT) response to the first output current;

wherein a gate biasing current and a source current for the first biasing transistor are substantially equal;

wherein a W/L ratio of the first and second biasing transistor are substantially equal;

a pair of cascoded transistors configured to operate as diodes and sink the third output current;

wherein the pair of cascoded transistors comprises a lower transistor that sinks the gate biasing current and biases the first biasing transistor; and wherein the lower transistor biases the first biasing transistor sufficient to maintain saturation of the first biasing transistor.

* * * * *